United States Patent [19]

Ingram

[11] Patent Number: 4,515,096

[45] Date of Patent: May 7, 1985

[54] TUFTING MACHINES

[75] Inventor: Gary L. Ingram, Ooltewah, Tenn.

[73] Assignee: Spencer Wright Industries, Inc., Chattanooga, Tenn.

[21] Appl. No.: 540,365

[22] Filed: Oct. 11, 1983

Related U.S. Application Data

[63] Continuation of Ser. No. 407,753, Aug. 13, 1982, abandoned.

[51] Int. Cl.[3] ..... D05C 15/00

[52] U.S. Cl. ..... 112/79 R

[58] Field of Search ..... 112/79 R

[56] References Cited

U.S. PATENT DOCUMENTS

| | | | |
|---|---|---|---|
| 3,653,346 | 4/1972 | Parsons | 112/79 R |
| 3,839,972 | 10/1974 | Scott et al. | 112/79 R |
| 3,857,345 | 12/1974 | Higgins | 112/79 R |

*Primary Examiner*—Ronald Feldbaum
*Attorney, Agent, or Firm*—Alan Ruderman

[57] ABSTRACT

A tufting machine having a cam mounted eccentrically on a main drive shaft about a center of rotation that may be varied by linear movement of the cam relative to the shaft along a slot elongated about a radial line interconnecting the geometric center of the cam with the locus of the rotational axes to change the stroke of the needles without changing the timing of the needles relatively to the loopers. A pair of locating plates fastened to the shaft have hubs received within the slot at preselected positions, the cam and plates having indexing holes that can be selectively aligned for the desired needle stroke. Another drive similar to the needle drive but 180 degrees out of phase therewith reciprocates a weighted carriage to counter-balance the rotating and reciprocating forces of the needle drive system. A threaded adjusting rod is threadedly received within hollow push rods for adjusting the needle bar to maintain the bottom dead center position of the needles at a predetermined position regardless of the selected stroke. A two member backing bar provides rigidity to the needle bar, the members being adjustable with respect to each other to provide a fine adjustment to the location of the bottom dead center of the needles.

23 Claims, 7 Drawing Figures

TUFTING MACHINES

This is a continuation of application Ser. No. 06/407,753, filed Aug. 13, 1982, now abandoned.

BACKGROUND OF THE INVENTION

This invention relates to tufting machines and more particularly to a high speed tufting machine having an adjustable eccentric drive for varying the needle stroke and having adjusting means for maintaining the position of the bottom of the stroke, the drive including needle load balancing means.

In the art of tufting one or more rows of yarn carrying needles are reciprocably driven through a base material fed through the machine to form loops that are seized by loopers oscillating below the base material in timed relationship with the needles.

The needles are mounted in a needle bar supported by a needle bar carrier at the end of a plurality of push rods constrained for reciprocatory motion. Conventionally, the push rods are driven by a linkage arrangement connected to a rock shaft which in turn is driven by a lever connected to an eccentrically mounted circular cam, or the push rods are connected to an eccentric strap driven by an eccentrically driven circular cam mounted on a rotating main shaft. An example of the former construction is disclosed in Cobble U.S. Pat. No. 2,977,905, and an example of the latter is illustrated in Ingram, et al U.S. Pat. No. 3,964,407 and in numerous other of the patented art.

When it is desired to change the depth of pile height produced by a tufting machine it is necessary to change the stroke of the needle, and the elevation of the bed plate relative to the loopers, the looper disposition remaining fixed. In conventional machines this involves either changing the eccentric cams which is a very time consuming process, or, in some linkage driven push rod machines, by providing a notch or slot in the rock shaft drive lever and by adjustably locating the connection of the drive cam in the slot. If the slot has a center of curvature coinciding with the geometric center of the cam when the latter is in the bottom dead center position, the bottom position of the push rods will remain fixed. If not, the bottom dead center position will change with changes in the needle stroke. In this latter situation, the bottom dead center will have to be corrected so that the needles and loopers retain their proper relationship, otherwise the loopers will not properly seize loops of yarn from the needles. This may be accomplished by the use of shims between the needle carrier and the needle bar or push rods, or by using needles of different lengths, both of which means are inconvenient and time consuming, the latter also requiring an inventory of needles having varying lengths.

The speed of tufting machines have increased substantially as the tufting art has gradually developed. At very high speeds, e.g., 1,000 rpm and above, the numerous levers and rocker arms of a linkage driven machine tend to wear excessively. Moreover, because of the lever arms used in this construction, there is a large torsional moment exerted on the rocker shaft especially at the top and bottom of the stroke, and this further reduces the useful life of such machines. Additionally, the oscillating movements of the levers in a linkage machine are more difficult to balance than a rotating system.

Because of such difficulties in the linkage drive, most prior art high speed tufting machines utilize rotating drive systems rather than the linkage drive construction. For example, a double eccentric drive is illustrated in Higgins U.S. Pat. No. 3,857,345, wherein one eccentric was mounted within and adjustable relative to the other to change the needle stroke. However, with this construction, when the needle stroke is changed, the timing between the reciprocation of the needles and the oscillation of the loopers is also changed, making it necessary to re-time the machine. It moreover had the same difficulty of repositioning the bottom dead center position and utilized a difficult to adjust cleavage device including a pair of plates that permitted only a minimum number of fixed settings and thus required extremely close tolerances in the production of the machine. Another approach, which is illustrated in Scott, et al U.S. Pat. No. 3,839,972, was to utilize an adjustable crankshaft in which the crank and connecting rods that drive the push rods could be repositioned relatively to the axis of the crankshaft. This proposal, however, had limitations on the amount of stroke adjustability available; the stub shafts comprising the crankshaft had to be changed when greater stroke variations were required so that a number of sets of such stub shafts had to be inventoried. Moreover, because of the large number of stub shafts and crank members required to comprise the crankshaft, wear was excessive and maintenance difficult.

Another difficulty of the prior art, and a major obstacle to attaining a reliable high speed machine, is that of balancing the dynamic loads in the head of the machine. In the aforesaid Scott, et al patent, balancing of the rotating system was attained by utilizing counter weights at ends of the stub shafts to counter balance the eccentricity of the crank. In another proposal, this being for a linkage drive system, a counter balancing rocker shaft is included within the head of the machine and included additional slotted levers driven by eccentric cams out of phase with the needle drive eccentric cams. Again only the rotating and oscillating system was balanced, and not the needle reciprocation system. The additional linkage required for balancing in that system additionally creates further wear and maintenance difficulties.

SUMMARY OF THE INVENTION

Consequently, it is a primary object of the present invention to provide a tufting machine capable of operating at high speed for long durations and in which the needle stroke can be varied readily through a wide range.

It is another object of the present invention to provide a tufting machine in which the needle stroke can be varied widely and the bottom dead center position of the needle bar maintained at a preselected position.

It is a further object of the present invention to provide a tufting machine having a variable eccentric drive for effecting needle reciprocation and in which the needle stroke can be varied without changing the relative timing between the needle reciprocation and the oscillation of the loop seizing instrumentalities.

It is a still further object of the present invention to provide a tufting machine having a counter-balancing system for balancing the rotating and reciprocating loads of the needle reciprocation drive system thereby permitting operation at greater speeds with less maintenance difficulties than heretofore possible.

It is yet a still further object of the present invention to provide in a tufting machine a needle drive system including an eccentric cam having a selectively variable eccentricity thereby permitting large changes to be made rapidly in the stroke of a needle bar and needles driven thereby.

It is yet another object of the present invention to provide in a tufting machine a needle drive system including an eccentric cam having a variable selectable center of rotation for permitting the center of rotation to be varied linearly relative to the geometric center of the cam such that large variations in the stroke of a needle bar driven thereby can be attained.

It is still yet another object of the present invention to provide in a tufting machine apparatus for maintaining the bottom dead center of the needle bar when the needle stroke is changed, the apparatus including threaded means for incremental adjustment of the needle bar relative to the frame of the machine and the loop seizing instrumentalities.

Accordingly, the present invention provides a needle drive for a tufting machine having an eccentric cam of variable eccentricity mounted on a main drive shaft about an adjustable center of rotation, the eccentricity being varied by linear movement of the cam relative to the shaft substantially along a radial line interconnecting the geometric center of the cam and the rotational axes to change the stroke of the push rods and thus the needles without changing the timing of the needles relatively to the loop seizing instrumentalities. In the preferred form of the invention the cam includes an elongated slot that can be positioned relative to the main shaft and secured thereto by at least one locating plate keyed to the shaft and having a hub receivable within the slot at selected positions, the cam and plate having a plurality of cooperating locating holes corresponding to different pile heights or strokes, the holes in the cam and plate being aligned for selective pile heights or strokes, and the plate and cam being secured together in the selected location.

Another aspect of the invention is the provision of a drive similar to the needle drive but out of phase therewith for reciprocating a weight equivalent to the push rods, needle bar and needles in a parallel path to balance the rotating and reciprocating forces generated by the moving needle system. Preferably the weight is secured to a platform constrained for reciprocation opposite to that of the push rods.

A further aspect of the invention is the provision of internally threaded hollow push rods for receiving a threaded adjustment member moveable relatively to the push rods to maintain the position of the bottom of the needle stroke when the needle stroke is changed. Thus, production of fabrics of various pile heights can be produced and the needle position compensated to maintain the correct position of loop seizure by the loopers. The adjustment member may be fastened to means secured to the needle bar and adjustably threaded into the lower end of the push rod so adjustment may be made externally of the machine head, or it may be secured to a drive member and threadily received within the top of the push rod to reduce the length of the reciprocating elements extending from the head.

A still further aspect of the invention is the reduction of the number of push rods normally utilized for driving the needle bar so as to reduce the number of needle drive mechanisms, thereby to reduce the weight of the reciprocating mass so that not only is higher speed operation possible but also reduction in the energy required to drive the system. To compensate for the smaller number of push rods supporting the needle bar against deflection, the present invention includes a backing bar that provides additional rigidity to the needle bar, and in the preferred form of the invention, the backing bar is a two member unit, one member being adjustable relative to the other so that fine adjustment can be made to the position of the needles at the bottom of the stroke to fine tune the point where the needles and loopers cross for loop seizure.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
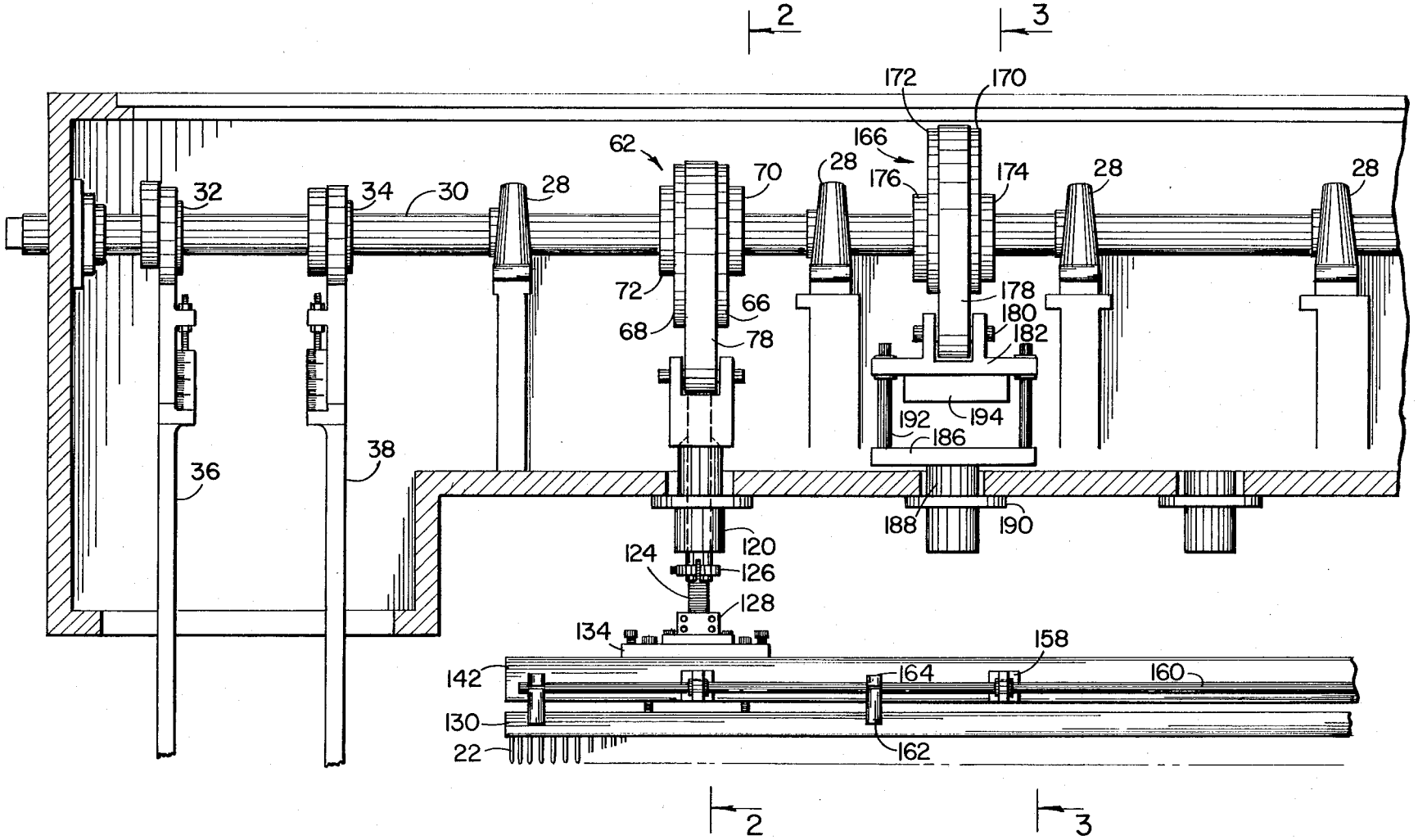
FIG. 1 is a fragmentary longitudinal sectional view through the head of a tufting machine incorporating needle driving apparatus constructed in accordance with the principles of the present invention.
Figure 2:
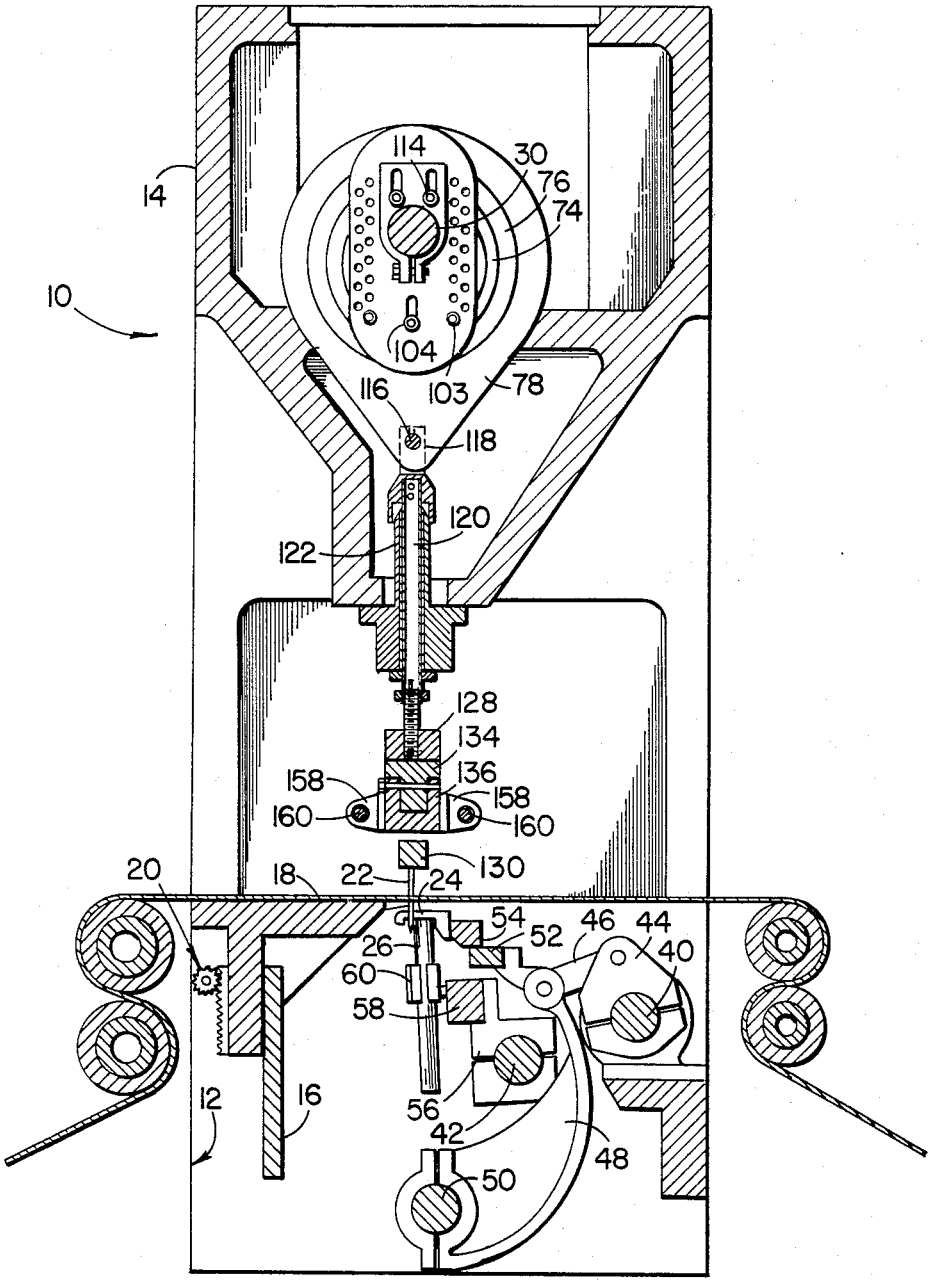
FIG. 2 is a cross sectional view taken substantially along line 2—2 of FIG. 1 and further illustrating loop seizing and cutting instrumentalities of the tufting machine.
Figure 3:
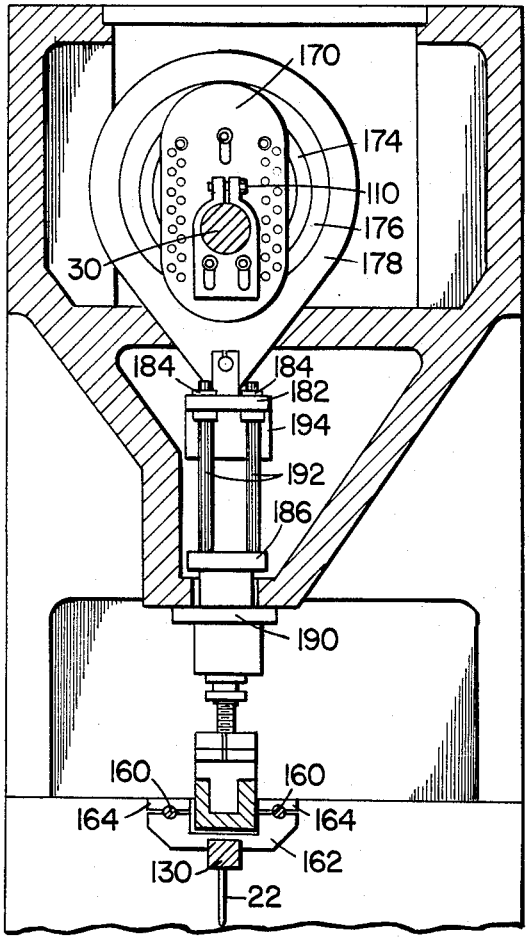
FIG. 3 is a cross sectional view taken substantially along line 3—3 of FIG. 1.

Referring now to the drawings there is illustrated a portion of a tufting machine 10 having a frame comprising a bed 12 and a head 14 disposed above the bed. The bed includes a bed plate 16 that carries a needle plate 18 vertically adjustable relative to the bed plate by conventional means such as a rack and pinion generally indicated at 20 and fully disclosed in the aforesaid Cobble, et al U.S. Pat. No. 2,977,905. Conventionally, a base material may be fed across the needle plate to be penetrated by a needle 22 reciprocating in the head 14 for forming loops beneath the base material. The loops are seized by instrumentalities such as a looper 24 oscillating in the bed 12 and may be cut by a knife 26 subsequent to seizure in a manner notoriously well known in the art.

Mounted longitudinally in a plurality of bearing supports 28 in the head 14 is the main shaft 30 which is rotated by means of a motor/speed reducer (not illustrated) and which in turn drives the various elements that reciprocate the needles 22, the hooks 24 and the knives 26. For example, eccentrically mounted cams 32 and 34 respectively drive an eccentric strap or pitman 36, 38 to drive rocking elements (not illustrated) to oscillate a looper jack shaft 40 and a knife shaft 42, and to supply the driving force for the needle drive system as hereinafter described. A jack shaft rocker arm 44 is clamped to the shaft 40 and is pivotably connected at one end to a link 46 having its other end pivotably connected to the upper portion of a looper rocker arm 48 clamped at its lower end to an idle shaft 50 journalled in the bed. The upper end of the rocker arm 48 carries a mounting bar 52 which in turn carries the looper mounting bar 54. A knife shaft rocker arm 56 is clamped to the knife shaft 42 and secures a knife bar 58 that carries the knife mounting block 60 in which the knives are mounted.

Figure 4:
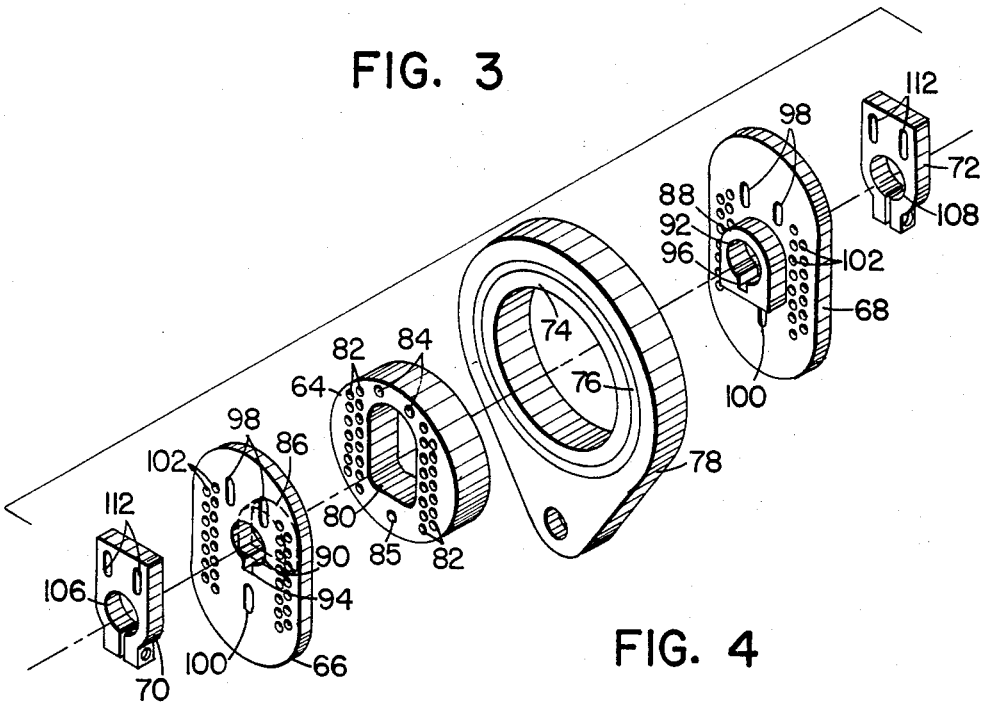
FIG. 4 is a dissassembled perspective view of 25 the eccentric cam drive members.

Carried on the main shaft at spaced locations are a number of needle drive eccentric assemblies generally indicated at 62 and, as best illustrated in FIG. 4, comprises an adjustable circular cam 64, a pair of locating plates 66, 68 and a pair of clamp blocks 70, 72. The cam 64 has a circular outer peripheral cam surface positioned within the inner race 74 of a bearing assembly having the outer race 76 positioned within the yoke of an eccentric strap 78. The cam 64 includes an elongated slot 80 in the central portion, the slot being symmetrical about a diametrical line of the cam and elongated along that line. The slot includes substantially straight opposed side edges substantially parallel to the axis of elongation, an arcuate edge at one end, and a substantially straight edge at the end opposite the arcuate edge and closer to the geometric center of the cam than the arcuate edge. A number of holes 82 are formed in the cam adjacent each side edge. Preferably, there are 15 such holes on each side spaced in two rows with each hole on one side having a corresponding hole on the other side. The holes in each row are spaced apart substantially equally and are intermediate the holes in the adjacent row. Each pair of holes on opposite sides of the axis of elongation, as hereinafter made clear, is for purposes of alignment with the plates 66, 68 and corresponds to a desired stroke of the needles. Adjacent one of the elongated ends of the slot 80, e.g., adjacent the arcuate edge are a pair of bolt receiving holes 84 spaced apart on opposite sides of the axis of elongation of the slot and a similar bolt receiving hole 85 is at the other end spaced from the staight edge and substantially on the axis of elongation.

Each of the locating plates 66, 68 is mounted on a respective side of the cam 64 and comprises an oval shaped member having a respective hub 86, 88 extending from the rear face thereof in the central portion. Each hub has a pair of substantially straight opposed side walls parallel to and spaced equally from the axis of elongation of the plate, a straight side wall at one end and an arcuate wall at the other end. The spacing between the side walls of the hub is slightly smaller than the spacing between the side edges of the slot 80 of the cam 64 so that the hub is receivable within the slot and moveable therein as constrained by the slot 80. Extending through each plate and hub is a circular aperture 90, 92 respectively having its center off-set along the axis of elongation of the respective plate toward one end. A key-way 94, 96 is formed in the periphery of the respective aperture 90, 92 adjacent the straight wall of the hub so the plates 66, 68 may be mounted on the main shaft 30 and keyed thereto. A pair of oval shaped bolt receiving slots 98 are formed on opposite sides of the elongation axis of each plate 66, 68 adjacent the arcuate wall of the hub, while a similar oval shaped bolt receiving hole 100 is formed along the elongation axis adjacent the straight wall of the hub.

Also formed in each plate 66, 68 are a plurality of holes 102 equal in number to the holes 82 in the cam 64 and spaced in similarly arranged double rows on each side of the hub. The center of each hole 102 in each row is spaced from the axis of elongation an amount equal to the amount the center of each hole 82 in a corresponding row of the cam is spaced from the elongation axis of the slot 80. However, the spacing between adjacent holes in the same row, although spaced equally apart and intermediate the holes in the adjacent row, are spaced apart slightly differently than the holes 82 of the cam. Thus, the holes 102 of the plates are locating holes and may have graphic indices corresponding to specific strokes of the needles, and for this purpose each pair of holes 102 may be aligned with a single corresponding pair of holes 82 in the cam. In the preferred embodiment, adjacent holes 102 of the plates 66, 68 are spaced apart 1/16 of an inch more than the holes 82 of the cam. Since there are 15 holes, the stroke can be varied by $\frac{7}{8}$ inch, i.e., 14 spaces between holes multiplied by 1/16 each, so the overall stroke variation from top dead center to bottom dead center is substantially $1\frac{3}{4}$ inches. Once the desired stroke is selected, the appropriate holes 102 of each plate 66, 68 are aligned with the corresponding pair of holes 82 of the cam 64 and a bolt 103 is inserted into the aligned holes on each side of the axes of elongation. Bolt 104 may thereafter be inserted into the slots 100 of the plates 66, 68 and the hole 85 in the cam.

The clamping blocks 70, 72 each have a respective main shaft receiving aperture 106, 108 and a bifurcated end opening into the respective aperture, the tines of the bifurcated end of each block 70, 72 being secured together by a bolt 110 to clamp the blocks to the main shaft 30. At the end opposite the bifurcated end of the blocks there are a pair of slots 112 similar to the slots 98 of the plate 66, 68 on opposite sides of the elongated axis of the blocks. Thus, bolts 114 may be inserted through the slots 112, 98 and the holes 84 so the cam 64 is sandwiched between the plates 66, 68 and clamping blocks 70, 72 and securely fastened to the main shaft with the selected eccentricity to provide the desired stroke.

Consequently, it should be clear that a change in needle stoke is made by disconnecting the bolts 104, 114 and 103, thereafter sliding the clamping plates 66 and 68 relative to the cam 64 as the hubs 86,88 are constrained within the slot 80, realigning the appropriate locating holes in the plates with the corresponding holes in the cam, and bolting the members back together. Since the plates 66 and 68 move linearly along the axis of the slot 80, the timing of the needle drive relative to the loopers and knives is not changed, and re-timing is not necessary as with the prior art variable eccentric drives.

Figure 5:
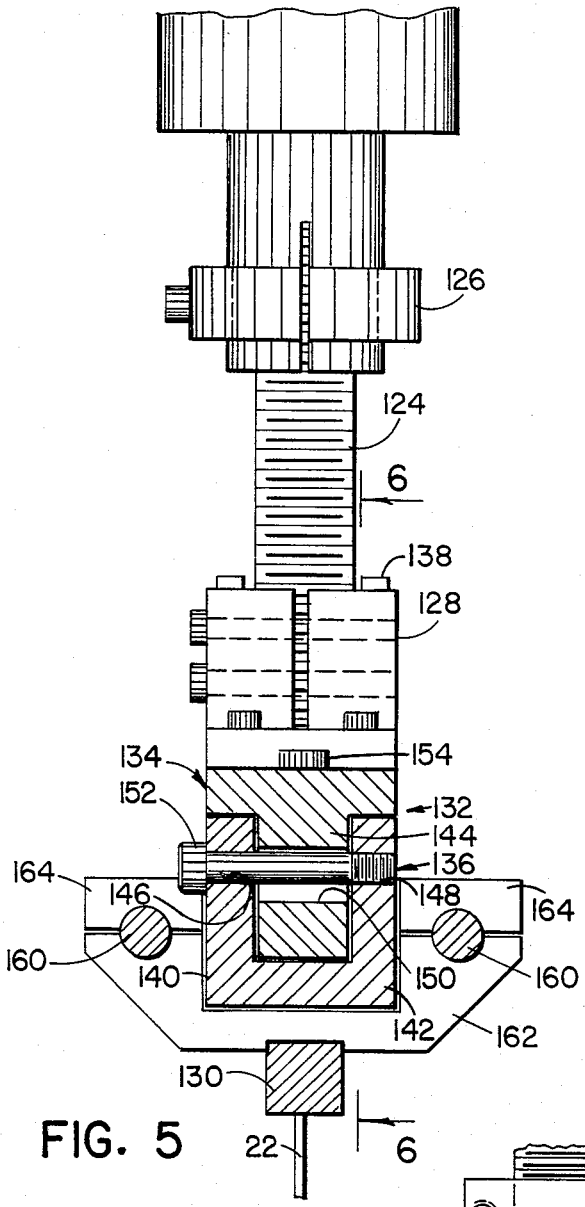
FIG. 5 is an enlarged elevational view of one form of the bottom dead center adjusting apparatus of the present invention.

The lower end of each eccentric strap 78 is pivotably connected at 116 to the upper end of a clevis member 118 that is further connected to the upper end of a push rod 120. Each push rod 120 is journalled in a push rod housing 122 secured to the head 14 for reciprocation of the push rod along a stroke determined by the eccentricity of the cam 64. For purposes of weight reduction and for purposes of maintaining the bottom point of the stroke of the needles substantially fixed, the push rods 120 are hollow cylindrical rods. As best illustrated in FIG. 5, in accordance with this aspect of the invention, each push rod 120 is threaded at its lower end and receives a threaded adjustment member 124 that can be threadily moved into or out of the hollow push rod to compensate for stroke changes to maintain the bottom dead center substantially fixed. A clamp 126 may be fastened to the lower end of the push rod to ensure a secure connection between the member 124 and the push rod. By providing threads with a proper lead, each turn of the adjustment member 124 will adjust the bottom of the stroke by a predetermined amount so that when the eccentricity of the cam 64 is changed for a different stroke, the adjustment member 124 may be fed into or out of the push rod 120 the substantially correct amount by a predetermined number of rotations of the member 124.

Figure 7:
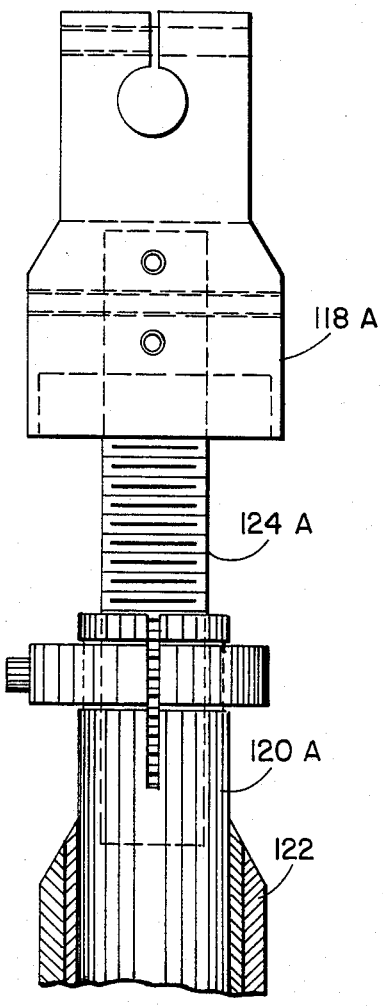
FIG. 7 is a view similar to FIG. 5 and illustrating a modified form of the bottom dead center adjusting apparatus.

Although the above construction permits bottom dead center positioning conveniently from outside the machine head 14, it may be desirable for structural reasons to have the positioning effected within the head. Thus, in the embodiment illustrated in FIG. 7, the adjustment member 124*a* may be secured at its top and to the clevis 118*a* and threadily received at its lower end within the top of the push rods 120*a* and securely clamped by clamp member 126*a*. Since this will provide a shorter reciprocating length outside the push rod housing, it should place less load on the housing and push rod due to the bending forces caused when the needle strikes the looper.

A push rod foot 128 is fastened to the lower end of each threaded adjustment member 124 and may directly carry a needle bar 130 which carries the needles 22, or a sliding needle bar support apparatus, as hereinafter described. However, according to another aspect of the invention, in order to reduce the number of push rods across the machine and prevent excessive deflection of the needle bar the push rod feet are connected to a backing bar generally indicated at 132 that carries the needle bar assembly and permits fine adjustments to be made to the bottom dead center position of the needles. The backing bar 132 basically comprises a pair of members 134, 136 adjustable relative to each other.

Figure 6:
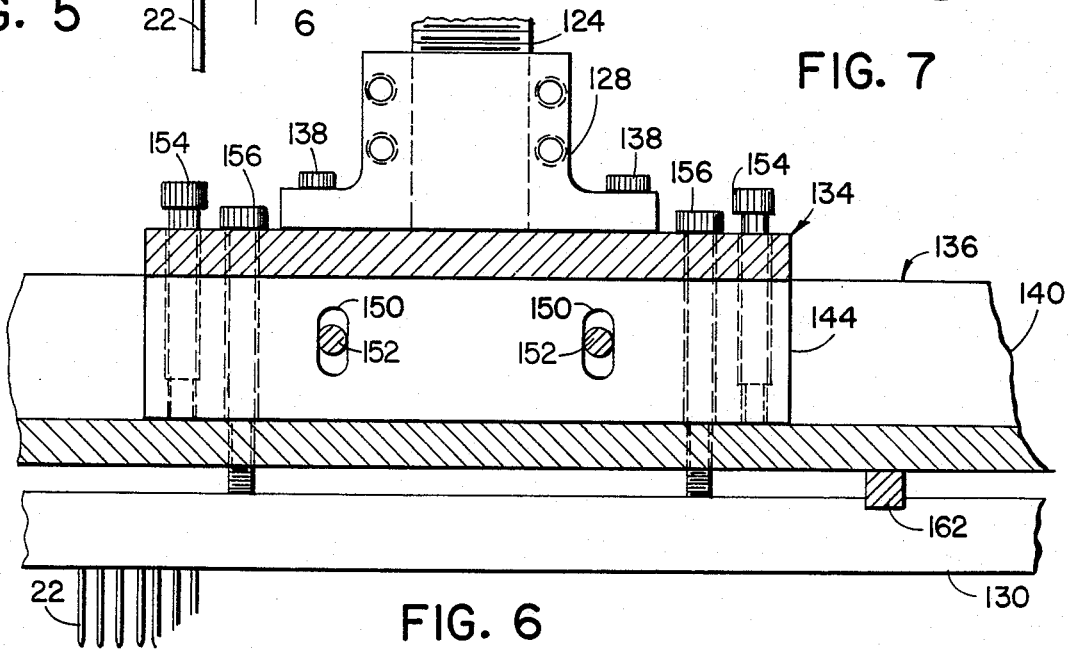
FIG. 6 is a cross sectional view taken substantially along line 6—6 of FIG. 5.

In the preferred embodiment there is one member 134 connected to the bottom of each push rod foot 128, and a single member 136 adjustably secured to the lower end of all of the members 134. As illustrated in FIGS. 5 and 6, each upper member 134 of the backing bar is a substantially T-shaped block elongated in the direction substantially parallel to the main shaft 30 and secured at the top of the cross-piece to the bottom of the push rod foot 128 by means of bolts 138 or the like. The lower member 136 is a substantially U-shaped member with the upstanding legs 140, 142 spaced apart slightly more than the width of the downwardly depending leg 144 of the member 134 which is received therebetween. The legs 140, 142 have a pair of aligned holes 146, 148 respectively, (only one pair being illustrated). Each pair of holes 146, 148 is spaced from the other pair and the holes 148 are threaded. The leg 144 of the member 134 includes a pair of elongated slots 150 spaced apart a distance substantially equal to the spacing between the holes 146 and the holes 148, and a bolt 152 extends through each hole 146, the corresponding slot 150 and is threadily received in the corresponding hole 148. When the bolts 152 are tightened the legs 140 and 142 are drawn together to clamp against the downwardly depending leg 144 of the member 134 to secure it in place.

Extending downwardly through a respective tapped hole formed through the top of the member 134 and through the leg 144 at opposite ends of the member 134 are a pair of adjustment screws 154 which extend into abutting relationship with the top surface of the center leg of the member 136. A similar pair of adjustment screws 156 threadily extend through the member 134 intermediate the screws 154 and the push rod foot 128 and are further threaded into tapped holes in the bottom leg of the member 136. The screws 154, 156 permit the member 136 to be adjusted vertically relatively to the member 134 for fine tuning of the bottom dead center of the needles. Thus, to raise the member 136 relative to the member 134, the bolts 152 are loosened, the screws 154 are backed-off, and the screws 156 are further tightened into the member 136. To lower the member 136 the screws 156 would be loosened and the screws 154 threaded further into the member 134 to move the member 136 further from the member 134. The bolts 152 are thereafter tightened to again clamp the members together.

The needle bar 130 may be connected directly to the backing member 136 if the needle bar is to be laterally fixed. However, as is customary in the tufting art, the needle bar may be mounted for 25 lateral shifting and is illustrated herein for such operation. Thus, a number of bearing supports 158 may be secured to the front and rear lower members 136 of the backing bar 132. Front and rear side rods 160 are journally carried in bearings within the bearing supports on respective front and rear sides of the backing bar, and a needle bar support 162 is connected to the two slide rods by a clamping member 164 clamped thereto. The needle bar 130 is fastened to the bottom of the needle bar support 162 and slidable therewith as controlled by means such as a cam drive mechanism (not illustrated).

In order to counter-balance the rotating and reciprocating mass of the needle drive system, the present invention provides counter-balancing means 166 intermediate each pair of spaced needle drives. The counter-balancing means 166 includes an eccentric cam 168, locating plates 170, 172, clamping blocks 174, 176 and an eccentric strap 178, respectively similar to the cam 64, locating plates 66, 68, clamping blocks 70, 72 and strap 78 of the needle bar drive, but mounted on the main shaft 30, 180 degrees out of phase therewith. Moreover, the lower end of each eccentric strap 178 is pivotably connected at 180 between a pair of upstanding walls fastened to the top of a moveable platform or carriage 182. The carriage 182 may be substantially rectangular in configuration and includes an aperture adjacent each corner for receiving a bushing 184. A stationary platform 186 is secured to a collar 188 positioned within a bore in the machine head 14. The collar includes a flange 190 that is secured to the head 14 to fix the platform 186. The stationary platform 186 is of a similar configuration as the carriage 182 and supports four rods 192 fastened thereto at positions corresponding to the bushing 184 so as to be journally received therein. Thus, as the main shaft 30 rotates and reciprocatorily drives the push rods 120 and the members carried thereby, the carriage 182 reciprocates in the opposite direction as constrained by the rods 192. A weight 194, substantially equal to the difference in weight between the push rod carrying members and the platform 186, is fastened to the carriage 182 and thus acts to balance the reciprocating needle driving mass.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth nature of the invention, what is claimed herein is:

1. In a tufting machine having a frame, a drive shaft rotatably carried by said frame, a circular cam eccentrically mounted on said shaft for rotation about preselected rotational axes off-set from the geometric center of the cam, a connecting rod operably connected to said cam and driven thereby, a needle bar, means constrained for movement in a linear path connecting said needle bar to said connecting rod for reciprocation of the needle bar, a plurality of needles carried by said needle bar, and a plurality of looper means for cooperating with said needles to seize loops of yarn presented thereby, the improvement comprising, adjusting means for changing the reciprocating stroke of said needles, said adjusting means comprising a slot extending through said cam for receiving said shaft, said slot being elongated along a radial line substantially interconnecting said geometric center and said rotational axes, said slot having spaced side walls substantially parallel to said radial line, and locking means for locking said cam to said shaft with the axis of said shaft at preselected positions along said radial line, said locking means comprising plate means including a hub protruding from a face thereof, means defining an aperture extending through said hub for receiving said shaft, said hub including substantially linear side walls spaced apart a distance substantially equal to the spacing between the side walls of said slot for receipt of said hub within said slot while permitting said cam to be positioned along said radial line, said cam and plate means including selectable cooperating indexing means corresponding to preselected eccentricities of said cam, means for fastening said cam to said plate means with said hub within said slot in a position corresponding to a preselected eccentricity, and means for fastening said plate means to said shaft.

2. In a tufting machine as recited in claim 1, wherein said means connecting the needle bar to the connecting rod includes a push rod, means for operably connecting said push rod to said connecting rod, a backing bar comprising a first member operably connected to said push rod and a second member operably connected to said needle bar, and means for adjustably securing said first and second members together at selected dispositions relative to each other, whereby the disposition of said needles at the bottom dead center position of the stroke may be adjusted relative to said push rod.

3. In a tufting machine as recited in claim 1, wherein said plate means comprises two plates, one plate being positioned adjacent each face of the cam, each plate having a protruding hub positioned within said slot.

4. In a tufting machine as recited in claim 1, wherein said indexing means comprises a plurality of spaced holes in said cam spaced from said slot, and an equal number of spaced holes in said plate means spaced from said hub, the holes in said plate means being spaced apart by a different amount than the holes in said cam, at least certain of said holes corresponding to different eccentricities of said cam when selected holes of the plate means are aligned with cooperating holes of said cam.

5. In a tufting machine as recited in claim 1, wherein said means for connecting said needle bar to said connecting rod includes threaded means for selectively adjusting said needle bar relative to said connecting rod for maintaining the bottom dead center position of said needle at a predetermined position regardless of the variation in stroke effected for said needles, thereby to maintain cooperation of said looper means with said needles.

6. In a tufting machine as recited in claim 5, wherein said means connecting said needle bar to said connecting rod includes a hollow push rod, said threaded means comprising a threaded adjustment member threadily received within said push rod.

7. In a tufting machine as recited in claim 2, wherein said push rod is hollow, and said threaded means comprises a threaded adjustment member threadily received within said push rod.

8. In a tufting machine as recited in claim 2, wherein said first member comprises a substantially T-shaped member having a downwardly depending central leg and a second member comprising a substantially U-shaped member having a pair of upstanding spaced legs adapted to receive said central leg therebetween, and means for securing said central leg of said first member between said upstanding legs of said second member in selected positions.

9. In a tufting machine as recited in claim 1, including eccentric means mounted on said drive shaft for counter-balancing the rotation of said eccentric cam, and means for counter-balancing the reciprocation of the reciprocating members.

10. In a tufting machine as recited in claim 9, wherein said eccentric means comprising a balancing eccentric cam mounted on said drive shaft, a balancing connecting rod operably connected to said balancing cam, a carriage, means operably connecting said balancing connecting rod to said carriage, means carried by said frame for constraining said carriage for movement in a reciprocating path, a weight carried by said carriage, and balancing adjusting means changing the reciprocating stroke of said carriage, said balancing cam, balancing adjusting means and balancing connecting rod being identical to the needle bar drive eccentric cam, adjusting means and connecting rod but mounted 180 degrees out of phase therewith, and the combined weight of said weight and carriage being substantially equal to the combined weight of the reciprocating needle driving members.

11. In a tufting machine having a frame, a drive shaft rotatably carried by said frame, an eccentric cam mounted on said drive shaft, a connecting rod operably connected to said cam and driven thereby, a needle bar, means including a push rod constrained for movement in a linear path for connecting said needle bar to said connecting rod for reciprocation of said needle bar, a plurality of needles carried by said needle bar, a plurality of looper means for cooperating with said needles to seize loops of yarn presented thereby, means for supporting a backing material intermediate said looper means and said needle bar for penetration by said needles, and adjusting means for changing the reciprocating stroke of said needles between a first point adjacent said looper means and a second point vertically spaced above said backing material, the improvement comprising, threaded adjusting means associated with said push rod for maintaining the bottom dead center position of said needles substantially at said first point regardless of the variation in stroke effected for said needles.

12. In a tufting machine as recited in claim 11, wherein said means for connecting said needle bar to said connecting rod comprises a backing bar having a first member operably connected to said push rod and a second member operably connected to said needle bar, and means for adjustably securing said first and second members together at selected dispositions relative to each other, whereby the disposition of the needle at the bottom dead center position of the stroke may be adjusted relative to said push rod.

13. In a tufting machine as recited in claim 11, wherein said push rod comprises a hollow cylindrical rod member, said threaded adjustment means comprising a threaded adjustment member threadily received within said push rod.

14. In a tufting machine as recited in claim 12, wherein said first member comprises a substantially T-shaped member having a downwardly depending central leg and a second member comprising a substantially U-shaped member having a pair of upstanding spaced legs adapted to receive said central leg therebetween, and means for securing said central leg of said first member between said upstanding legs of said second member in selected positions.

15. In a tufting machine as recited in claim 13, wherein said threaded adjustment member is a threaded rod having its upper end received within the lower end of said push rod, and means for fastening the lower end of said threaded rod to said needle bar.

16. In a tufting machine as recited in claim 13, wherein said threaded adjustment member is a threaded rod threadedly having its bottom end received within the upper end of said push rod, and means for fastening the upper end of said threaded rod to said connecting rod.

17. In a tufting machine as recited in claim 15, wherein said means for fastening said threaded rod to said needle bar comprises, a backing bar having a first member operatively connected to said threaded rod and a second member operatively connected to said needle bar, and means for adjustably securing said first and second members together at selected dispositions relative to each other, whereby the disposition of the needles at the bottom dead center position may be adjusted by rotatably feeding said threaded rod into and out of said push rod and by adjusting said second member relatively to said first member.

18. In a tufting machine as recited in claim 17, wherein said first member comprises a substantially T-shaped member having a downwardly depending central leg and a second member comprising a substantially U-shaped member having a pair of upstanding spaced legs adapted to receive said central leg therebetween, and means for securing said central leg of said first member between said upstanding legs of said second member in selected positions.

19. In a tufting machine having a frame, a drive shaft rotatably carried by said frame, an eccentric cam mounted on said drive shaft, a connecting rod operably connected to said cam and driven thereby, a needle bar, means constrained for movement in a linear path connecting said needle bar to said connecting rod for reciprocation of said needle bar, and a plurality of needles carried by said needle bar, the improvement comprising, a balancing eccentric cam mounted on said drive shaft, a balancing connecting rod operably connected to said balancing cam and driven thereby, said balancing eccentric cam and said balancing connecting rod being disposed 180 degrees out of phase with the needle bar driving eccentric cam and connecting rod, a carriage, means carried by said frame for constraining said carriage for movement in a reciprocating path, and weight means carried by said carriage, the combined weight of said weight means and carriage being substantially equal to the combined weight of said needle bar, said needles and said means connecting said needle bar to said connecting rod, whereby the reciprocating forces in said machine are substantially balanced.

20. In a tufting machine as recited in claim 19, wherein said eccentric cam and said counter-balancing eccentric cam are identical circular cams eccentrically mounted on said shaft for rotation about preselected rotational axes off-set from the geometrical center of the respective cam, means defining a slot extending through each cam for receiving said shaft, each slot being elongated along a radial line substantially interconnecting the respective geometric center and said rotational axes, and locking means for locking each of said cams to said shaft for preselected eccentricities with the axis of said shaft at preselected positions along the respective radial lines.

21. In a tufting machine as recited in claim 20, wherein each of said slots has spaced side walls substantially parallel to the respective radial line, each of said locking means comprising identical plate means including a hub protruding from a face thereof, means defining an aperture extending through each hub for receiving said drive shaft, each hub including substantially linear side walls spaced apart a distance substantially equal to the spacing between the side walls of the respective slot for receipt of the hub in said slot while permitting each cam to be positioned along the respective radial line, each cam and respective plate means including selectable cooperating indexing means corresponding to preselected eccentricities of the cams, means for fastening each cam to the respective plate means with the respective hub within each slot in a position corresponding to a preselected eccentricity, and means for fastening each plate means to said shaft.

22. In a tufting machine as recited in claim 20, wherein each plate means comprises two plates, one plate being positioned adjacent each face of the respective cam, each plate having a protruding hub positioned within the slot of the respective cam.

23. In a tufting machine as recited in claim 21, wherein said indexing means comprises a plurality of spaced holes in each of said cams spaced from the respective slot, and an equal number of spaced holes in each plate means spaced from the respective hub, the holes in each of said plate means being spaced apart by a different amount than the holes in the respective cam, at least certain of the holes corresponding to different eccentricities of each cam when selected holes of the respective plate means are aligned with cooperating holes of each cam.

* * * * *